US008284973B2

(12) United States Patent
Gabathuler et al.

(10) Patent No.: US 8,284,973 B2
(45) Date of Patent: Oct. 9, 2012

(54) HEARING DEVICE WITH MICROPHONE PROTECTION

(75) Inventors: Bruno Gabathuler, Grueningen (CH); Andre Lucien Ochsenbein, Wolfhausen (CH)

(73) Assignee: Phonak AG, Staefa (CH)

( * ) Notice: Subject to any disclaimer, the term of this patent is extended or adjusted under 35 U.S.C. 154(b) by 131 days.

(21) Appl. No.: 12/532,224

(22) PCT Filed: Mar. 27, 2007

(86) PCT No.: PCT/EP2007/052937

§ 371 (c)(1), (2), (4) Date: Sep. 21, 2009

(87) PCT Pub. No.: WO2008/116500

PCT Pub. Date: Oct. 2, 2008

(65) Prior Publication Data

US 2010/0086159 A1 Apr. 8, 2010

(51) Int. Cl.
*H04R 25/00* (2006.01)

(52) U.S. Cl. ..... 381/322; 381/328; 381/312

(58) Field of Classification Search ..... None
See application file for complete search history.

(56) References Cited

U.S. PATENT DOCUMENTS

| | | | | |
|---|---|---|---|---|
| 3,749,853 | A | 7/1973 | Ely et al. | |
| 4,553,627 | A * | 11/1985 | Gastmeier et al. | 181/135 |
| 4,800,982 | A * | 1/1989 | Carlson | 181/130 |
| 6,349,790 | B1 * | 2/2002 | Brimhall | 181/135 |
| 6,585,075 | B1 * | 7/2003 | Gauthier | 181/135 |
| 7,013,016 | B2 * | 3/2006 | Wolf | 381/324 |
| 7,471,800 | B2 * | 12/2008 | Neilson | 381/325 |
| 7,499,561 | B2 * | 3/2009 | Hanses et al. | 381/325 |
| 7,953,241 | B2 * | 5/2011 | Jorgensen et al. | 381/356 |
| 2005/0169492 | A1 * | 8/2005 | Topholm | 381/322 |

FOREIGN PATENT DOCUMENTS

| | | |
|---|---|---|
| DE | 20122543 U1 | 4/2006 |
| EP | 0310866 A1 | 4/1989 |

OTHER PUBLICATIONS

International Search Report for PCT/EP2007/052937, dated Dec. 28, 2007.

Written Opinion for PCT/EP2007/052937, dated Dec. 28, 2007.

* cited by examiner

*Primary Examiner* — Yuwen Pan
*Assistant Examiner* — Taunya McCarty
(74) *Attorney, Agent, or Firm* — Pearne & Gordon LLP

(57) ABSTRACT

The hearing device comprises at least one microphone (2) arranged within the housing (3) of the hearing device, with its sound inlet aperture (2') being connected via a canal (7) to the outside of the housing (3) and a sound permeable cover (10) serving as microphone protection that is arranged in the region of the outlet opening of said canal (7). The canal (7) of the hearing device is provided as a blind hole and the microphone (2) is arranged at the side of said canal (7) and at least one opening or channel (9) is provided connecting said canal (7) with said sound inlet aperture (2') of said microphone (2). By providing the canal (7) as a blind hole, all dirt eventually intruding the canal (7) will be collected at the bottom (7") of canal (7) and will therefore not reach directly the microphone (2) or the sound inlet openings of the microphone (2) respectively.

20 Claims, 2 Drawing Sheets

HEARING DEVICE WITH MICROPHONE PROTECTION

TECHNICAL FIELD

The present invention relates to a hearing device according to the preamble of claim 1 and to a microphone protection device according to the preamble of claim 9.

The term hearing device shall be understood as a device to be worn at the vicinity or directly within the ear of a person to improve the individual hearing capacity of this person. Such an improvement may include the prevention of the receiving of certain acoustic signals in terms of ear protection. In relation to the application of such hearing devices they can be worn behind the ear (BTE), within the ear (ITE) or completely within the ear (CIC).

Such hearing devices normally comprise of at least one microphone as acoustic receiving element, a speaker as acoustic output element and an electronic element connected with said microphone and said speaker for the processing and inducement of electronic signals. This electronic element may comprise analogue or digital signal processing devices.

Said elements are usually arranged within a shell of the hearing device.

BACKGROUND

A number of devices for the protection of microphones of such hearing devices are known. For instance the protection coverings for the microphone openings of hearing devices are firmly integrated or glued to battery doors or face plates or modules of hearing devices. In case of dirt they have to be cleaned in an extensive and time-consuming manner.

U.S. Pat. No. 4,987,597 discloses for instance a covering plate for the protection of an opening facing to the outside of a hearing device. The covering plate is plugged from the outside over the opening to be protected of the respective device and comprises openings that are covered by sound permeable membranes. The construction disclosed requires a coupling element protruding from the respective hearing device to the outside for receiving the covering plate, for plug in the covering plate. Such a coupling element is on one hand optically disturbing and on the other hand susceptive to receive dirt due to its sharp edges. Such a covering plate furthermore shows the risk of unintentional or independent loosening and therefore may be lost or may penetrate into the ear canal of the person wearing the hearing device. Furthermore, only the opening of the hearing device showing in direction of the ear is covered, i.e. only the sound emission opening will be covered and protected. Thus, only the sound emission opening will be protected from being contaminated by dirt deriving from the ear canal, but not the microphone inlet aperture at the outside of the hearing device shell.

From DE 20208601 U1 a covering element for the sound inlet aperture is known comprising of a plastic flange with plastic gossamer stretched over the opening. Thus a protection of the microphones impermeable for cerumen is provided. Nevertheless, such a covering element only has a weak dimensional stability thereby forming crevices between the opening and the covering element accessible for dirt and humidity.

In WO 97/09864 a further device for the protection of openings directed towards the ear or ear canal is known. The respective openings are closed by a porous pin that is plugged into the canal associated to the respective opening. Such a pin may in practice disadvantageously not be removed from said opening or canal after its insertion. Thus, the pin may only be cleaned together with the hearing device, thereby remaining in its inserted position within the canal or opening. Another problem arises during the assembly of the pin, as the pin may be pushed too far or too deep into the respective canal or opening. As a result, an open chamber is provided and thus dirt may be deposited and thereby plugging the respective opening.

EP 1 439 733 further discloses a microphone protection for hearing devices with a flange in form of a ring. The flange comprises racks spanning over the opening of the flange. The flange further comprises stop elements to limit the possible insertion depth of the flange into the microphone opening of the housing of the hearing device. Thus, a damaging or displacing of the microphone by the microphone protection during the insertion process will be prevented.

SUMMARY

All the above mentioned known devices have a common disadvantage, namely that any dirt being located between the microphone cover or microphone protection and the microphone itself will not be removed by replacing said microphone cover or microphone protection. In addition, there is a high risk that such dirt will be dislocated further in direction towards the microphone by inserting a new microphone cover, thus further plugging the opening or canal of the microphone.

A problem to be solved by the present invention is finding a microphone protection that does not influence or plug the opening of the microphone or the microphone itself during its insertion or replacement.

This problem is inventively solved by a hearing device according to the specifications of claim 1. Further embodiments result from the characteristics of the further claims 2 to 8.

The inventive hearing device with at least one microphone arranged within the housing of the hearing device, with its sound inlet aperture being connected via a canal to the outside of the housing and wherein a sound permeable cover serving as microphone protection is arranged in the region of the outlet opening of said canal providing said canal as a blind hole and having the microphone arranged at the side of said canal. This inventive device further provides at least one opening or channel connecting said canal with said sound inlet aperture of said microphone. The microphone is thus acoustically connected via said canal and the openings or channel with the ambient. By providing the canal as a blind hole, all dirt eventually intruding the canal will be collected at the bottom of said canal and will therefore not reach directly the microphone or the sound inlet openings of the microphone respectively. That reduces the risk of plugging the sound inlet openings essentially and increases the fail-safe ability of the microphone. The canal itself is thereby closed by a detachable cover insertable from the outside, the cover being sound permeable, thereby already reducing substantially the risk of penetration of dirt or humidity.

For instance said cover is provided as a pin or plug filling completely the cross section of said canal that is preferably arranged at the entrance of said canal. The cover may thus easily be inserted into the canal and will be hold firm but detachable within said canal. A subsequently removal or exchange may thus easily be performed.

Said pin or plug is for instance provided as a hollow body with at least one opening at its top and is further provided with recesses arranged laterally at the inside wall of said hollow body. Thus, a sound acoustic transmittance is assured and the risk of bringing dirt or humidity directly to the sound inlet openings of the microphone is substantially reduced or eliminated by providing laterally arranged recesses. The recesses thereby provide the channel between the canal and the microphone or the inlet aperture of said microphone respectively. Thus the pin or plug provides at the same time the blind hole channel and the connection channel for the microphone in one piece.

The recesses are for instance provided as slots arranged parallel with respect to the longitudinal axis of the hollow body and preferably extending overall the whole length of the hollow body.

The cover has for instance a head closing tight with the outlet opening of canal and having a stop area to be brought in contact with a limiting surface arranged within said canal. The cover thus provides an exactly defined penetration depth and may easily be assembled into its correct position.

Said head for instance provides a round flange as rim with its lower part acting as stop area and having one or several inlet openings on its top. Sound from the ambient may thus be entering the canal through said openings into the hollow part of said cover.

The inlet openings are for instance covered by a screen or fleece. The penetration of dirt or particles may thus be reliably avoided.

Said cover consist for instance of a one-piece plastic element. Such a part may easily be built for example with injection molding, deep-drawn or turning techniques with a high degree of fitting accuracy.

The present problem will further inventively be solved by a microphone protection according the features of claim 9. Further inventive embodiments will arise from the features of the further claims 10 to 11.

The inventive microphone protection for an antecedently described inventive hearing device has a mushroom-shaped body, with a head provided as a round flange comprising at least one inlet opening facing to the outside and with a base part provided by a hollow cylindrical body.

Said body has for instance recesses that are preferably provided as slots arranged parallel with respect to the longitudinal axis of said body. A sound acoustic transmission from the ambient of the hearing device to the microphone will thus be ensured without the risk of dirt elements penetrating into the microphone.

The microphone protection is for instance built as a one-piece plastic element, preferably a deep-drawn or turned plastic element. Such elements may therefore be produced cost efficiently and with high precision in large quantities.

For purpose of facilitating and understanding of the invention, there is illustrated in the accompanying drawings preferred embodiments thereof to be considered in connection with the following description. Thus the invention may be readily understood and appreciated.

DETAILED DESCRIPTION

Figure 1:
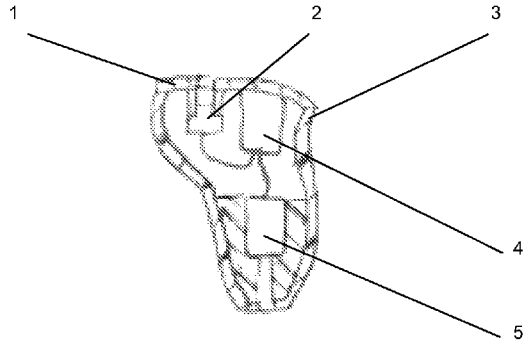
Fig. 1 PRIOR ART
FIG. 1 is a schematic longitudinal section of a common ITE hearing device.

FIG. 1 is showing the schematic longitudinal section through a common ITE hearing device with faceplate 1, a microphone 2 arranged at said faceplate 1 and a shell 3 connected to said faceplate 1. An electronic module 4 is arranged within shell 3 as well as a speaker 5, for treating the acoustic signals received by microphone 2 by electronic module 4 and transmitting said signals acoustically to the person wearing the hearing device by said speaker 5 through the ear canal. The sound from the ambient will reach microphone 2 by a canal 7 arranged to directly connect the microphone 2 with the ambient of the ITE hearing device.

Figure 2:
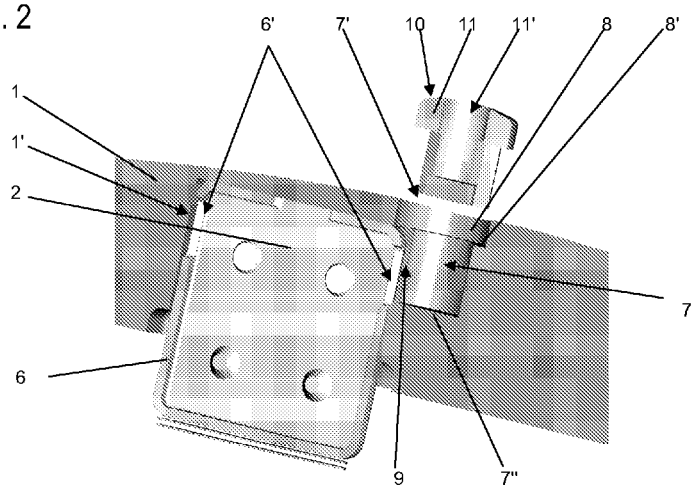
FIG. 2 is a schematic longitudinal section through a faceplate of a hearing device with microphone and a microphone protection according the present invention.

FIG. 2 depicts in details the longitudinal section of the area of the microphone 2 of a hearing device according the present invention. Microphone 2 is surrounded with a wrapping 6 consisting of elastic material that is inserted within respective recesses 1' of faceplate 1. The wrapping 6 has several openings 6' located at the area of the inlet aperture of microphone 2 for providing a direct sound access to the inlet aperture of microphone 2.

Adjacent of recess 1' for microphone 2 a canal 7 is provided accessible from the outside of faceplate 1. Said canal 7 is provided as a blind hole, i.e. it has beside of an inlet opening 7' a closed bottom 7", and does thus not provide a direct connection between the ambient and microphone 2.

Canal 7 of FIG. 2 is provided as a cylindrical opening or bore and has a ring-shaped, circular expansion 8 at its top facing towards the outside of faceplate 1. The circular face 8', arranged perpendicular to the longitudinal axis of canal 7 and facing outwardly, serves as a stop for microphone protection 10.

At least one recess or channel 9 is arranged along the cylindrical shaped inner wall of canal 7 thereby providing a connection between canal 7 and recess 1' containing microphone 2. The recess or channel 9 opens out into opening 6' of the wrapping 6 of microphone 2 thereby enabling the acoustic signals arriving from the ambient over canal 7, channel 9 and recess 1' to the microphone 2 and thereby to the inlet aperture of microphone 2 as described above.

Figure 3:
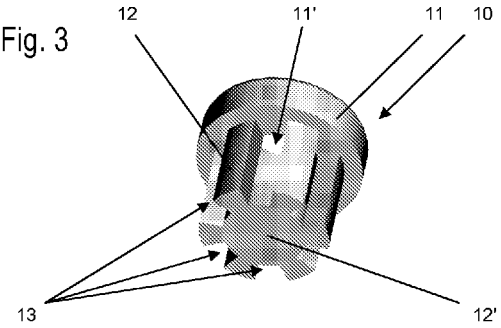
FIG. 3 is the schematic view of a microphone protection according the present invention.

Microphone protection 10 is provided substantially as a cylindrical, mushroom-shaped plug as can be seen in FIG. 3 in its non-assembled state outside of canal 7. The head 11 of microphone protection 10 has a slightly concave shaped surface and a rounded rim running over into the cylindrically shaped shell of head 11.

Groovings or slots 13 are provided along the circumference of base part 12, arranged parallel to the longitudinal axis of microphone protection 10. Said groovings or slots 13 are preferably arranged extending overall the whole length of base part 12, said base part 12 being provided as a hollow cylinder. Thus, the above mentioned acoustic connection between the ambient and microphone 2 remains assured even with microphone protection 10 inserted within canal 7. The sound transmission between the inside of microphone protection 10 and the microphone 2 will then be realized through said slots 13 and channel 9, forming a sound channel towards microphone 2.

Bottom 12' of base part 12 may for instance be closed but said bottom 12' may as well be open shaped.

The opening of microphone protection 10 thus establishes a blind hole, whereby any dirt eventually intruding into this opening may not attain directly to microphone 2. The only opening or several openings arranged at the head 11 of microphone protection 10 may for instance be covered or over spanned by porous material, fabrics or filter elements that assure the acoustic permeability but avoid the intrusion of dirt particles.

Canal 7 may be provided with a great length due to the laterally arranged recesses 1' of microphone 2, for instance practically overall the entire thickness of faceplate 1. This permits the realization of relative long microphone protections 10 without the need of increasing the thickness of faceplate 1 or the need of additional space in longitudinal direction of microphone protection 10. The microphone 2 may thus in particular be positioned close to the outer rim of faceplate 1 resulting in a favorable room layout within the hearing device. Recess 1' may for instance be arranged close to the outer surface of faceplate 1 whereby microphone 2 requires less room within the hearing device compared to common ITE hearing devices with microphone protection.

Yet another advantage lies in the fact that by replacing the present inventive microphone protection 10 any dirt invaded into the inside of the microphone protection 10 will thereby be removed from the hearing device as well. Any dirt possibly intruded through the openings of head 11 of microphone protection 10 into its hollow body will be collected at the preferably closed bottom 12' and therefore completely removed in case of the replacement of microphone protection 10.

An improvement of the quality of the hearing device will thus be achieved. By reliably protecting microphone 2 from dirt and humidity the life cycle of the hearing device will be extended finally resulting in lesser breakdowns and replacement actions and lower service fees for the user of the hearing device.

What is claimed is:

1. Hearing device comprising:

at least one microphone arranged within a housing of the hearing device, the microphone comprising a sound inlet aperture being connected via a canal to the outside of the housing, and a sound permeable cover serving as microphone protection arranged in a region of an outlet opening of said canal, characterized in that said canal is provided as a blind hole adapted to receive at least part of said microphone protection, and that the microphone is arranged at the side of said canal and that at least one opening or channel is provided from the canal connecting said canal with said sound inlet aperture of said microphone.

2. Hearing device according to claim 1, characterized in that the sound permeable cover is provided as a pin or plug filling completely the cross section of said canal.

3. Hearing device according to claim 2, characterized in that said pin or plug is provided as a hollow body with at least one opening at its top and that said channel is provided by recesses arranged laterally at the inside wall of said hollow body.

4. Hearing device according to claim 3, characterized in that the recesses are provided as slots arranged parallel with respect to the longitudinal axis of the hollow body.

5. Hearing device according to claim 1, characterized in that the sound permeable cover has a head tightly closing the outlet opening of said canal and having a stop area to be brought in contact with a limiting surface arranged within said canal.

6. Hearing device according to claim 5, characterized in that said head provides a round flange or rim with its lower part acting as stop area and having one or several inlet openings on its top.

7. Hearing device according to claim 6, characterized in that the inlet openings are covered by a screen or fleece.

8. Hearing device according to claim 1, characterized in that said sound permeable cover comprises a one-piece plastic element.

9. Microphone protection device having a mushroom-shaped body comprising: a head provided as a round flange comprising at least one inlet opening facing to the outside, and a base part provided by a hollow cylindrical body having a cylindrical-shaped inner wall comprising at least one recess or channel arranged therein and having a closed bottom.

10. Microphone protection device according to claim 9, characterized in that said hollow cylindrical body has recesses.

11. Hearing device according to claim 8, characterized in that said one-piece plastic element is a deep-drawn or turned plastic element.

12. Hearing device according to claim 2, wherein said pin or plug is arranged at the entrance of the canal.

13. Hearing device according to claim 4, wherein said slots extend overall the whole length of the hollow body.

14. Microphone protection device according to claim 10, wherein said recesses are provided as slots arranged parallel with respect to the longitudinal axis of said hollow cylindrical body.

15. Hearing device according to claim 1, wherein all of the surfaces of inner walls of the blind hole are formed in the faceplate.

16. Hearing device according to claim 1, wherein said blind hole is formed in a faceplate of the housing, a longitudinal axis of said blind hole is substantially perpendicular to an outer surface of the faceplate.

17. Hearing device according to claim 1, wherein all of the surfaces of inner walls of the blind hole of the said opening or channel are formed in the faceplate.

18. Hearing device according to claim 17, wherein said opening or channel perpendicularly faces a longitudinal axis of said blind hole.

19. Hearing device according to claim 1, wherein said blind hole has a closed end opposite an inlet opening of the blind hole and an inner surface of the closed end is substantially parallel to an outer surface of the faceplate.

20. Hearing device according to claim 1, wherein said blind hole is a cylindrical shape formed in a faceplate of the housing, a longitudinal axis of said blind hole is substantially perpendicular to an outer surface of the faceplate, and all of the surfaces of inner walls of the blind hole are formed in the faceplate.

* * * * *